US010047948B1

(12) United States Patent
Qiu

(10) Patent No.: US 10,047,948 B1
(45) Date of Patent: Aug. 14, 2018

(54) TORCH TAIL CAP AND TORCH

(71) Applicant: NINGBO HONGFU ALUMINIUM & PLASTIC ELECTRIC APPLIANCE CO., LTD., Zhejing Province (CN)

(72) Inventor: Enyuan Qiu, Zhejing Province (CN)

(73) Assignee: NINGBO HONGFU ALUMINUM & PLASTIC ELECTRIC APPLIANCE CO., LTD., Zhejing Province (CN)

( * ) Notice: Subject to any disclaimer, the term of this patent is extended or adjusted under 35 U.S.C. 154(b) by 0 days.

(21) Appl. No.: 15/668,201

(22) Filed: Aug. 3, 2017

(30) Foreign Application Priority Data

Mar. 24, 2017 (CN) ..... 2017 2 0293830 U

(51) Int. Cl.

| | |
|---|---|
| ***F21S 13/02*** | (2006.01) |
| ***F21V 33/00*** | (2006.01) |
| ***F21V 23/04*** | (2006.01) |
| ***B25D 1/02*** | (2006.01) |
| *F21V 19/00* | (2006.01) |
| *B25F 1/04* | (2006.01) |

(52) U.S. Cl.
CPC ..... *F21V 33/0076* (2013.01); *B25D 1/02* (2013.01); *F21V 23/0407* (2013.01); *F21V 23/0421* (2013.01); *B25F 1/04* (2013.01); *F21V 19/009* (2013.01)

(58) Field of Classification Search
None
See application file for complete search history.

(56) References Cited

U.S. PATENT DOCUMENTS

| | | | | |
|---|---|---|---|---|
| 9,114,752 | B2 * | 8/2015 | Petrucelli | B60Q 7/00 |
| 2012/0240417 | A1 * | 9/2012 | Lee | A62B 3/00 30/366 |
| 2018/0119944 | A1 * | 5/2018 | Tang | F21V 33/0084 |

FOREIGN PATENT DOCUMENTS

| | | |
|---|---|---|
| CN | 203273304 U | 11/2013 |
| CN | 203273305 U | 11/2013 |
| CN | 205079076 U | 3/2016 |
| CN | 205299170 U | 6/2016 |

* cited by examiner

*Primary Examiner* — Vip Patel
(74) *Attorney, Agent, or Firm* — Heslin Rothenberg Farley & Mesiti P.C.; Victor A. Cardona, Esq.

(57) ABSTRACT

A torch tail cap includes a tail cap base which has a middle portion provided with an inner cavity, a life hammer which is axially inserted into the inner cavity of the tail cap base, and a retractable ring which is rotationally installed on the periphery of the tail cap base and is connected with the life hammer. The retractable ring drives the life hammer to extend out of or retract back into the inner cavity during rotation. The life hammer can be conveniently accommodated in the tail cap when not in use.

18 Claims, 5 Drawing Sheets

TORCH TAIL CAP AND TORCH

CROSS REFERENCE TO RELATED APPLICATIONS

This application claims priority to Chinese Application No. CN201720293830.7 filed Mar. 24, 2017. The entire disclosure of the prior application is hereby incorporated herein by reference.

BACKGROUND OF THE INVENTION

1. Technical Field

The present invention belongs to the mechanical technical field and relates to a torch tail cap and a torch.

2. Description of Related Art

In daily life, torches and life hammers are common lighting tools and safety tools for breaking window glass to escape. The two kinds of tools are usually separate units, which brings inconvenience in carrying and use when people go out traveling. In order to meet people's demands when people go out traveling by riding in vehicles or go out for self-driving travel, the torch and the life hammer need to be assembled to generate a torch with a life hammer. The tails of rod-like tools such as a torch are provided with tail cap components in a fixed connection or a detachable connection way. The life hammer is usually disposed on a tail cap, facilitating carrying and use during the travel.

In the prior art, the life hammer-type torches are basically the same in structure, or the life hammer is directly fixed at the bottom of the torch tail cap, or the life hammer is fixed at a lateral portion of the torch tail cap, so the life hammers are all exposed and protruding out of the surfaces of the torch tail caps. The life hammer is a cone with a large head and a small tail, and the front tip of the head is shaped as a sharp tip, so during movement and placement, the life hammer tends to cause personal injuries when touching human bodies and cause damage to other objects when colliding with other objects.

In conclusion, it is needed to design a torch tail cap with a life hammer which can be conveniently accommodated in the tail cap when not in use and a torch having a torch tail cap.

BRIEF SUMMARY OF THE INVENTION

The objective of the present invention is to provide a torch tail cap with a life hammer which can be conveniently accommodated in the tail cap when not in use and a torch to solve the problems in the prior art.

The objective of the present invention can be achieved by the following technical solution: A torch tail cap includes:

a tail cap base, having a middle portion provided with an inner cavity;

a life hammer, axially inserted in the inner cavity of the tail cap base; and, a retractable ring, rotationally installed on the periphery of the tail cap base and connected with the life hammer, wherein the retractable ring is capable of driving the life hammer to extend out or retract back into the inner cavity during rotation.

As a further improvement of the present invention, a support rack for fixing the life hammer is movably installed in the inner cavity; the retractable ring is connected with the support rack; and by rotating the retractable ring, the support rack, together with the life hammer, is driven to move axially.

As a much further improvement of the present invention, the inner wall of the retractable ring is in a threaded connection with the outside wall of the support rack; the support rack is circumferentially limited in the inner cavity; and the retractable ring is axially limited on the periphery of the tail cap base.

As a much further improvement of the present invention, a plurality of pins matched with the retractable ring are integrally and circularly disposed on the periphery of the support rack; the outside walls of the plurality of pins are all formed with external screw thread structures; and the inner wall of the retractable ring is in a threaded connection with the outside walls of all the pins at the same time.

As a further improvement of the present invention, the tail cap base is provided with a plurality of guide sleeves which extend from the middle portion to the tail of the tail cap base and are matched with the support rack; the inner cavity is formed by enclosing the guide sleeves; the life hammer extends out of the tail of the tail cap base when extending out; the guide sleeves and the pins correspond to each other one by one and are disposed at intervals; two adjacent guide sleeves enclose to form a limiting gap which communicates with the inner cavity and circumferentially limits a corresponding one of the pins; and all the pins are respectively circumferentially limited in corresponding limiting gaps.

As a further improvement of the present invention, the outside wall of the tail of each one of the guide sleeves is provided with a thread head; a rear cap which axially limits the retractable ring is disposed at the tail of the tail cap base; the tail cap base is positioned at the middle portion of the tail cap base; the inner wall of the rear cap is in a threaded connection with the thread connections of all guide sleeves at the same time; the middle portion of the rear cap is formed with a central through-hole through which the life hammer extends out and retracts.

As a much further improvement of the present invention, a step structure is disposed on the inner side of the tail of each one of the guide sleeves, and the step structures enclose to form a support step; and a support retainer ring which is pressed against the inner wall of the rear cap is disposed in a way of tightly fitting the support step.

As a much further improvement of the present invention, the end face of the tail of the support retainer ring is leveled with the end faces of the tails of the guide sleeves.

As a much further improvement of the present invention, a reinforcing ring tightly fits the inner side of the central through-hole.

As a much further improvement of the present invention, four pins are provided; the four pins are distributed on the periphery of the support rack in a "crossed" shape; and four corresponding limiting gaps are also distributed on the tail cap base in a way of a "crossed" open slot structure.

As a much further improvement of the present invention, the middle portion of the support rack is formed with a support through-hole, and the end portion of one end of the life hammer close to the middle portion of the tail cap base is inserted into the support through-hole and is tightly connected with the support rack.

As a further improvement of the present invention, a separating ring is disposed at the middle portion of the tail cap base; the retractable ring is rotationally installed in the middle portion of the tail cap base and is connected with the separating ring; a first groove which is positioned on one side of the separating ring that faces the tail of the tail cap base is disposed on the periphery of the middle portion of the tail cap base; and a damping rubber ring which contacts the retractable ring is disposed in the first groove.

As a further improvement of the present invention, external thread connections are disposed on the periphery of the head of the tail cap base.

As a further improvement of the present invention, a plurality of concave anti-skidding grooves are circumferentially disposed on the periphery of the retractable ring.

As a further improvement of the present invention, the middle portion of the head of the tail cap base is formed with a countersink; an electrode cap fixing seat is tightly installed in the countersink; an electrode cap is inserted into the head of the electrode cap fixing seat; the electrode cap is exposed out of the head of the tail cap base;

a spring is disposed in the electrode cap fixing seat; and the two ends of the spring are respectively pressed against the inner wall of the electrode cap and the middle portion of the tail cap base.

A torch includes a torch body and a torch tail cap disposed at the tail of the torch body, wherein the head of the tail cap base and the torch body are in a detachable connection.

As a further improvement of the present invention, a second groove that is positioned on one side of the separating ring that faces the head of the tail cap base is disposed on the periphery of the middle portion of the tail cap base, and a sealing rubber ring which contacts the torch body is disposed in the second groove.

A torch is characterized by including a torch body and a torch tail cap disposed at the tail of the torch body, wherein the head of the tail cap base and the torch body are in a detachable connection.

A torch includes a torch body and a torch tail cap disposed at the tail of the torch body, wherein the tail cap base and the torch body are in a fixed connection, and here the fixed connection means that the tail cap base and the torch body are fixedly installed together or integrally connected.

Based on the above technical solution, the embodiments of the present invention can generate at least the following technical effects. The entire structure of the torch tail cap is rational and compact. The life hammer is controlled to retract back and extend out by rotation, so it is more convenient and quick. The tail cap base is provided with an inner cavity which accommodates the life hammer and the life hammer can conveniently retract into the inner cavity of the tail cap when not in use. If the life hammer needs to be used when various accidents and traffic accidents occur, the retractable ring on the tail cap can be manually rotated such that the life hammer extends out of the bottom face of the tail cap, and then the life hammer can be used to break the window glass of cars, so people can rescue themselves and escape. When the torch tail cap is applied to a tool such as a torch, the hammer has the features of convenient operation and use, safe movement, saving of placement space, etc. Moreover, the torch tail cap can be adapted to the tails of the torch bodies of torches of different styles to form a multi-functional torch with a rescue function.

BRIEF DESCRIPTION OF THE SEVERAL VIEWS OF THE DRAWINGS

The present invention is described in further detail in conjunction with the attached drawings and embodiments, wherein.

Figure 1:
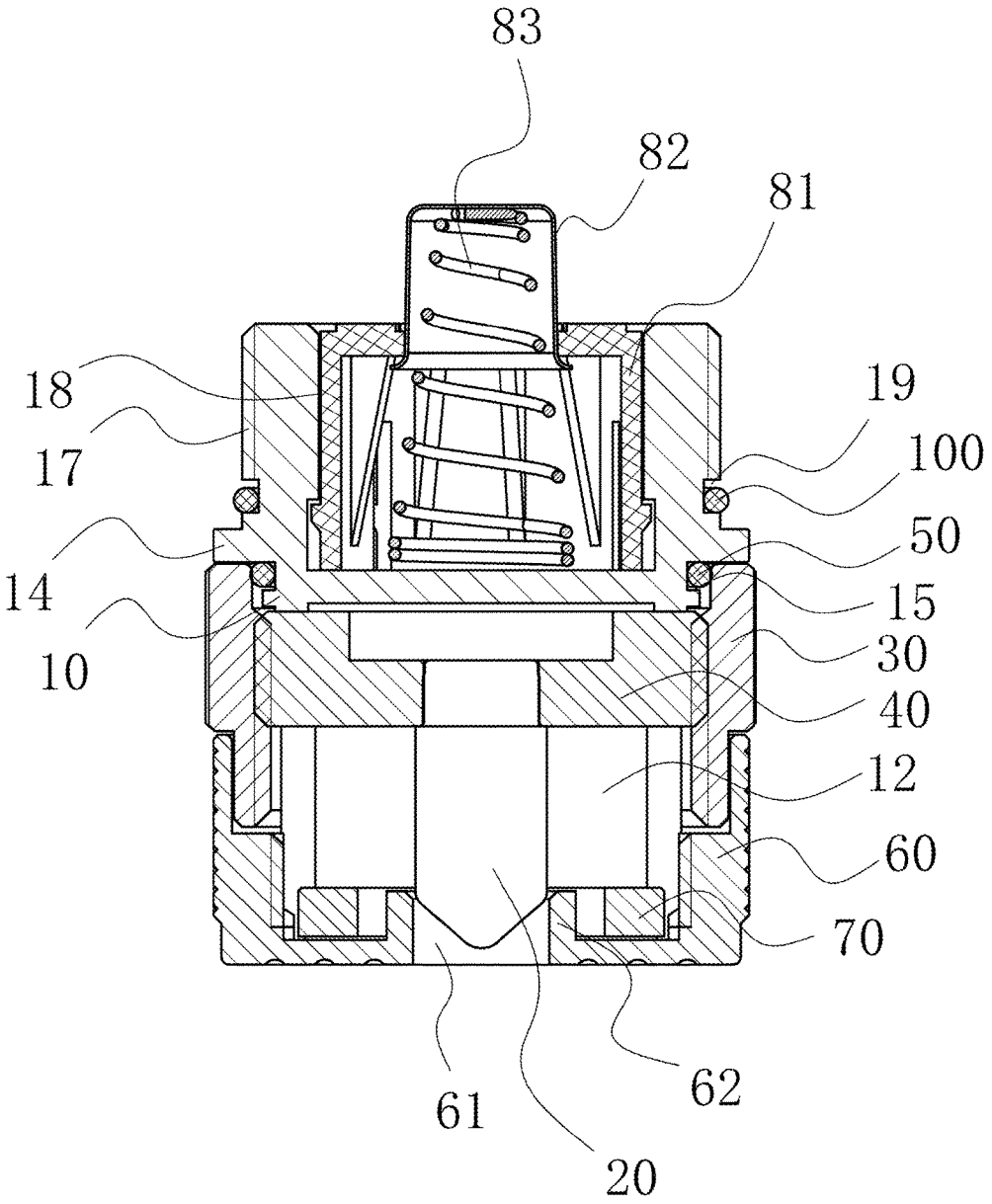
FIG. 1 is a structural view of a preferable embodiment of the present invention, in a state that a life hammer is accommodated in the torch tail cap.
Figure 2:
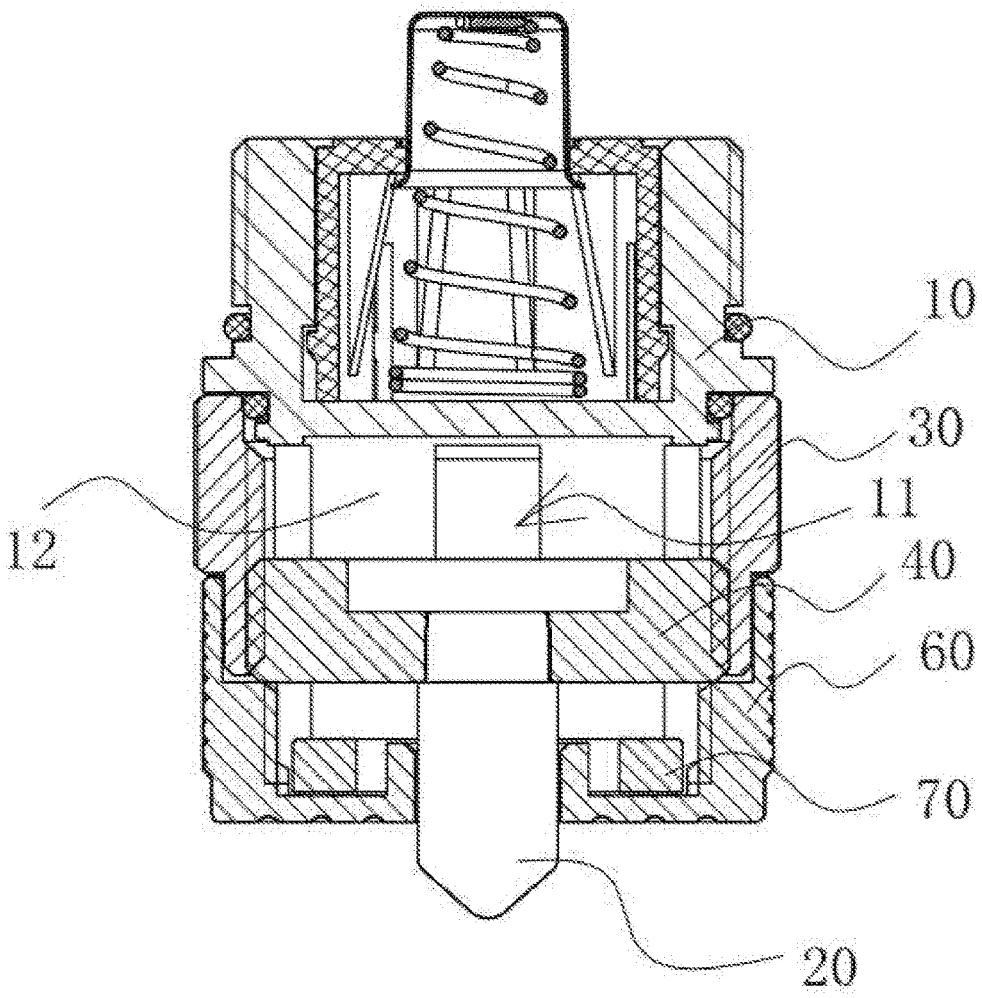
FIG. 2 is a structural view of a preferable embodiment of the present invention, in a state that a life hammer extends out of the torch tail cap.
Figure 3:
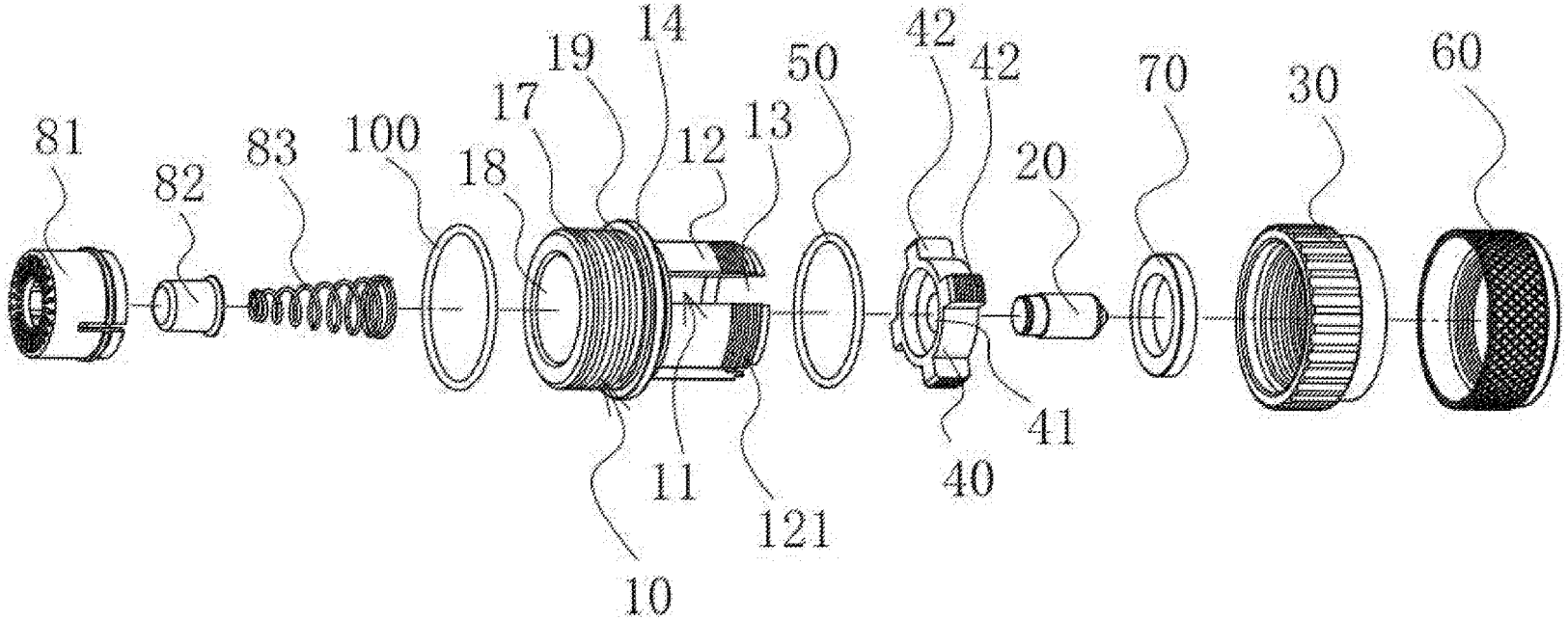
FIG. 3 is an exploded view of a torch tail cap in a preferable embodiment of the present invention.
Figure 4:
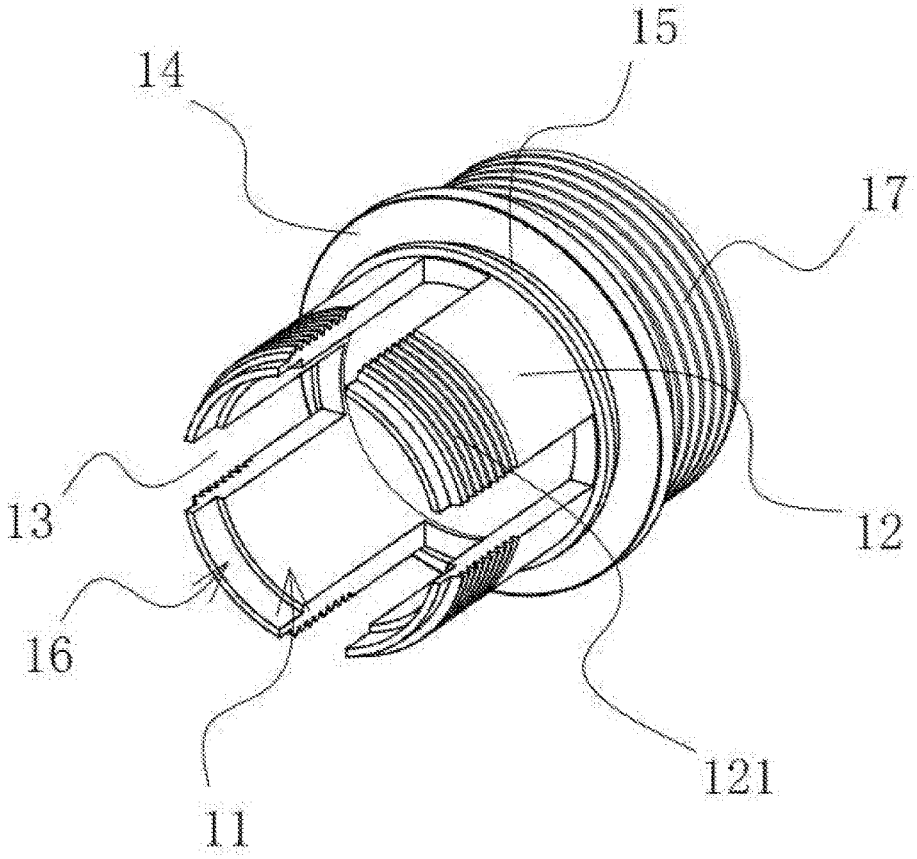
FIG. 4 is a structural view of a torch tail cap in a preferable embodiment of the present invention.

In the figures, 10. tail cap base; 11. inner cavity; 12. guide sleeve; 121. thread connection; 13. limiting gap; 14. separating ring; 15. first groove; 16. support step; 17. external thread joints; 18, countersink; 19. second groove; 20. life hammer; 30. retractable ring; 40. support rack; 41. support through-hole; 42. pin; 50. damping rubber ring; 60. rear cap; 61. central through-hole; 62. reinforcing ring; 70. support retainer ring; 81. electrode cap fixing seat; 82. electrode cap; 83. spring; 90. torch body; 100. sealing rubber ring.

DETAILED DESCRIPTION OF THE INVENTION

The technical solution of the present invention is further described in conjunction with the preferred embodiments and attached drawings of the present invention, but the present invention is not limited to those embodiments.

Life hammers on existing torch tail caps are all disclosed in an exposed way and cannot be accommodated in tail caps. The life hammers have sharp tips which tend to cause personal injuries when touching human bodies during movement and placement and to cause damage to other objects when colliding with other objects. Therefore, it is necessary to design a relatively rational torch tail cap and a torch with the torch tail cap.

The technical solution provided by the present invention is described in further detail in conjunction with FIG. 1-FIG. 5.

As shown in FIG. 1-FIG. 4, the torch tail cap includes:

a tail cap base 10, serving as a main support carrier of a tail cap, wherein the middle portion of the tail cap base is formed with an inner cavity 11;

a life hammer 20, axially inserted in the inner cavity 11 of the tail cap base 10; and, a retractable ring 30, rotationally installed on the periphery of the tail cap base 10 and connected with the life hammer 20, wherein the retractable ring 30 is capable of driving the life hammer 20 to extend out of or retract back into the inner cavity 11 during rotation.

The torch tail cap claimed by the present invention is a part of a rod-like tool such as a torch, preferably a torch part, in particular a torch tail cap with a hammer.

In the present invention, the inner cavity 11 is an inner cavity 11 with an opening to adapt with the life hammer 20. When rotating the retractable ring 30, the life hammer 20 can be driven to extend out of the whole tail cap via the opening of the inner cavity 11, and the life hammer 20 is axially disposed on the torch tail cap, so to break an object, the stress at the tip of the life hammer 20 is concentrated. The life hammer 20, the torch tail cap and the rod-like tool used such as the torch are aligned and can achieve an ideal effect, so it is quicker and more reliable to break windows and save life. Such torch tail cap is more adapted to rod-like tools such as torches. Moreover, in the case the life hammer 20 in the present solution is accommodated in the inner cavity 11, preferably, the life hammer 20 can be completely enclosed in the inner cavity 11, which means that the life hammer 20 is completely enclosed when not in use. Such torch tail cap has a better service effect and is safe and reliable.

The entire structure of the torch tail cap is rational and compact. The life hammer 20 is controlled to retract back and extend out by rotation, so it is more convenient and quick. The tail cap base 10 is provided with an inner cavity 11 which accommodates the life hammer 20, and the life hammer 20 can conveniently retract into the inner cavity 11 of the tail cap when not in use. If the life hammer 20 needs to be used when various accidents and traffic accidents occur, the retractable ring 30 on the tail cap can be manually rotated such that the life hammer 20 extends out of the bottom face of the tail cap, and then the life hammer 20 can be used to break the window glass, so people can rescue themselves and escape. When the torch tail cap is applied to a tool such as a torch, the hammer has the features of convenient operation and use, safe movement, saving of placement space, etc. Moreover, the torch tail cap can be adapted to the tails of the torch bodies of torches of different styles to form a multi-functional torch with a rescue function.

As a preferred or optional implementation mode, a support rack 40 for fixing the life hammer 20 is movably installed in the inner cavity 11; the retractable ring 30 is connected with the support rack 40; the support rack 40 together with the life hammer 20 can be driven to move axially by rotating the retractable ring 30, thus realizing extension and retraction of the life hammer 20.

In the present solution, the life hammer 20 and the support rack 40 move synchronously, ensuring the stability of the movement of the life hammer 20, also further reinforcing the support reliability of the life hammer 20.

Further, the inner wall of the retractable ring 30 is in a threaded connection with the outside wall of the support rack 40; the support rack 40 is circumferentially limited in the inner cavity 11 and the retractable ring 30 is axially limited on the periphery of the tail cap base 10; and after the installation of the retractable ring 30 is completed, the retractable ring 30 can only circumferentially rotate on the tail cap base 10.

By such structure setting, the axial movement of the retractable ring 30 can be prevented. Through mutual threaded connection, the setting of the circumferentially limited support rack 40 and the setting of the axially limited retractable ring 30, when the retractable ring 30 is manually operated to rotate, the support rack 40 can only move axially to drive the life hammer 20 to extend out or retract back into the tail cap synchronously.

As an optimization, in order to ensure the circumferential limiting effect of the support rack 40, namely the circumferential limiting effect of the life hammer 20, a plurality of pins 42 matched with the retractable ring 30 are integrally and circularly disposed on the periphery of the support rack 40; the outside walls of the plurality of pins 42 are all formed with external screw thread structures; and the inner wall of the retractable ring 30 is in a threaded connection with the outside walls of all the pins 42 at the same time.

Further preferably, the tail cap base 10 is provided with a plurality of guide sleeves 12 which extend from the middle portion to the tail of the tai cap base 10 and are matched with the support rack 40; the inner cavity 11 is formed by enclosing the guide sleeves 12; the life hammer 20 extends out of the tail of the tail cap base 10 when extending out; the guide sleeves 12 and the pins 42 correspond to each other one by one and are disposed at intervals; two adjacent guide sleeves 12 enclose to form a limiting gap 13 which communicates with the inner cavity 11 and circumferentially limits a corresponding one of the pins 42; and all the pins 42 are respectively circumferentially limited in corresponding limiting gaps 13. In this way, the entire support rack 40 is circumferentially limited in the inner cavity 11 of the tail cap base 10.

Further, the outside wall of the tail of each one of the guide sleeves 12 is provided with a thread connection 121; a rear cap 60 which axially limits the retractable ring 30 is disposed at the tail of the tail cap base 10; the tail cap base 10 is positioned at the middle portion of the tail cap base 10; the inner wall of the rear cap 60 is in a threaded connection with the thread connections 121 of all the guide sleeves 12 at the same time; the middle portion of the rear cap 60 is formed with a central through-hole 61 through which the life hammer 20 extends out and retracts. In the present solution, the retractable ring 30 is axially pressed by the rear cap 60 on the periphery of the middle portion of the tail cap base 10, and preferably the retractable ring 30 partly extends into the rear cap 60.

In order to further ensure the working reliability, preferably, a reinforcing ring 62 tightly fits the inner side of the central through-hole 61, and the reinforcing ring 62 is preferably integrally molded with the rear cap 60, avoiding wearing the life hammer 20 when the life hammer 20 extends out and retracts, and also ensuring the structural strength of the rear cap 60.

Much further, in order to ensure uniform stress and balanced support and to ensure the reliability of working, four pins 42 are preferably provided, and the four pins 42 are distributed on the periphery of the support rack 40 in a "crossed" shape, and four corresponding limiting gaps 13 are also distributed on the tail cap base 10 in a way of a "crossed" open slot structure. The structure of the uniform equal-interval distribution of the pins 42 and corresponding limiting gaps 13 well ensures the circumferential limiting effect of the support rack 40 and ensures that the support rack 40 can only drive the life hammer 20 to axially linearly move in the inner cavity 11.

Preferably, the middle portion of the support rack 40 is formed with a support through-hole 41 which is in a close fit and connection with the life hammer 20; the end portion of one end of the life hammer 20 close to the middle portion of the tail cap base 10 is inserted into the support through-hole 41 and is tightly connected with the support rack 40, ensuring the support balance and uniform stress of the life hammer 20, and preventing the life hammer 20 from shaking and retracting in use.

In the present solution, further preferably, the life hammer 20 is provided with a step-like platform structure which is adapted to the support through-hole 41, and after the end portion of the life hammer 20 is inserted into the support through-hole 41, the platform is pressed against the middle portion of the support rack 40, so the fixation is firmer and more stable.

Further, a separating ring 14 for separating the head from the tail is disposed at the middle portion of the tail cap base 10; the retractable ring 30 is rotationally installed at the middle portion of the tail cap base 10 and is connected with the separating ring 14; a first groove 15 which is positioned on one side of the separating ring 14 that faces the tail cap base 10 is disposed on the periphery of the middle portion of the tail cap base 10, and a damping rubber ring 50 which contacts the retractable ring 30 is disposed in the first groove 15 to play a certain damping effect during the rotation of the retractable ring 30.

In order to ensure the structural strength and working stability and to ensure fixation firmness, the separating ring 14 is preferably integrally connected with the guide sleeves 12 and the tail cap base 10.

In order to improve the hand feel and the anti-skidding effect of the manual rotation of the retractable ring 30, a plurality of anti-skidding grooves are circumferentially formed on the periphery of the retractable ring 30, and preferably, the anti-skidding grooves are formed at an equal interval.

Preferably, a step structure is disposed on the inner side of the tail of each one of the guide sleeves 12; the step structures enclose to form a support step 16; and a support retainer ring 70 which is pressed against the inner wall of the rear cap 60 is disposed in a way of tightly fitting the support step 16.

Further preferably, the end face of the tail of the support retainer ring 70 is leveled with the end faces of the tails of the guide sleeves 12; and the support retainer ring 70 supports the guide sleeves 12 to prevent the tails (namely the ends close to the rear end 60) of the guide sleeves 12 from deforming by an external force.

Preferably, external thread joints 17 are disposed on the periphery of the head of the tail cap base 10 to facilitate connection between the tail cover and structures such as the torch body of the torch, which is convenient, practical and labor-saving.

In the present invention, the torch tail cap is also provided with an electrode component. Specially, the middle portion of the head of the tail cap base 10 is formed with a countersink 18; an electrode cap fixing seat 81 is tightly installed in the countersink 18; an electrode cap 82 is inserted into the head of the electrode cap fixing seat 81; the electrode cap 82 is exposed out of the head of the tail cap base 10; a spring 83 is disposed in the electrode cap fixing seat 81; and the two ends of the spring 83 are respectively pressed against the inner wall of the electrode cap 82 and the middle portion of the tail cap base 10.

Figure 5:
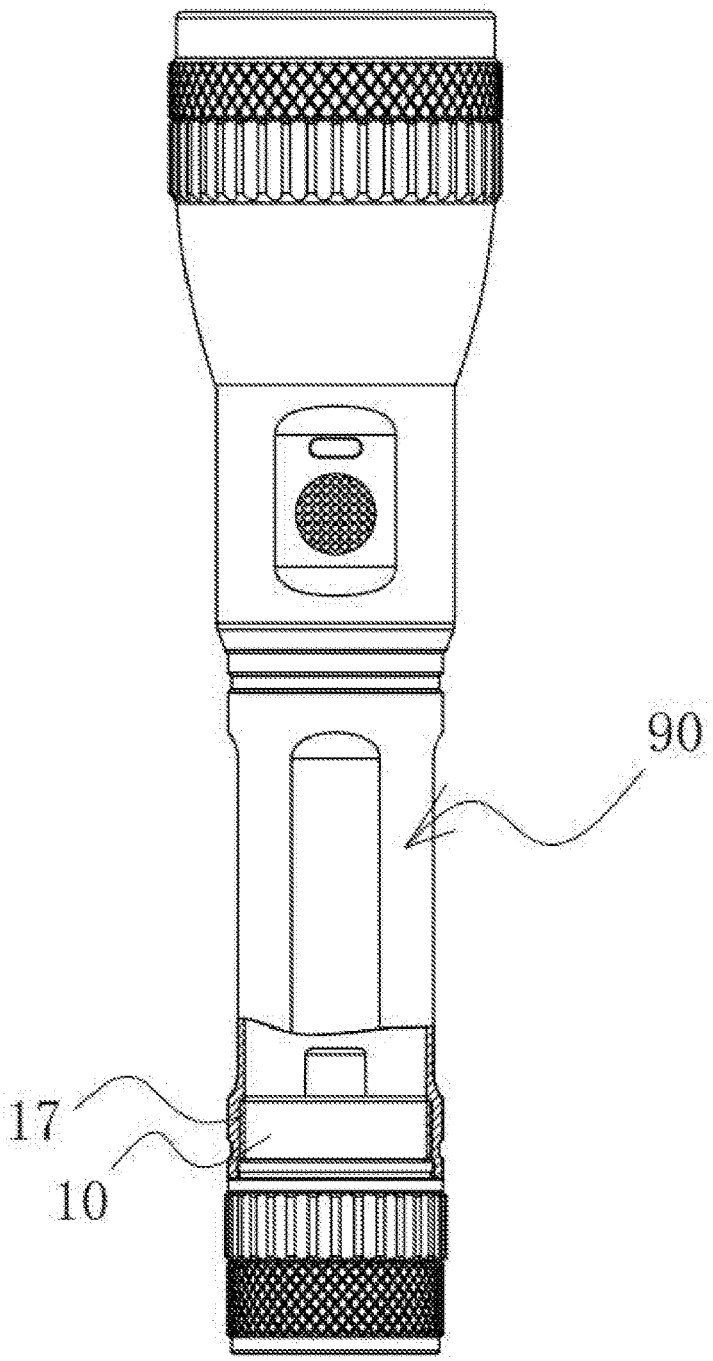
FIG. 5 is a structural view of a torch tail cap in a preferable embodiment of the present invention.

Refer to FIG. 5. The present invention also claims a torch having the torch tail cap, specifically, a torch having the torch tail cap with the life hammer 20.

Specifically, the torch includes a torch body 90 and the torch tail cap disposed at the tail of the torch body 90; the head of the tail cap base 10 and the torch body 90 are in a detachable connection. Here, the detachable connection is preferably a threaded connection. Threaded connection is also a kind of detachable connection.

Further, in order to ensure the tightness of connection between the torch tail cap and the torch body 90, a second groove 19 which is positioned on one side of the separating ring 14 that faces the head of the tail cap base 10 is disposed on the periphery of the middle portion of the tail cap base 10, and a rubber sealing ring 100 which contacts the torch body 90 is disposed in the second groove 19.

The present invention also claims a torch having the torch tail cap. The torch includes a torch body 90 and the torch tail cap disposed at the tail of the torch body 90, and the tail cap base 10 and the torch body 90 are in a fixed connection. Here, the fixed connection means that the tail cap base 10 and the torch body 90 are fixedly installed together or integrally connected. Namely, in practical use, the torch body 90 and tail cap base 10 of the torch can be fixed as a whole body, which is another embodiment of the torch in the present solution.

In conclusion, the tail cap is a torch tail cap which can be matched with and in a threaded connection with the tail of the torch body of the torch to form a multi-functional torch with a rescue effect. In use, the torch is a lighting tool at ordinary times; when the life hammer is needed in various emergencies or in traffic accidents, the torch body of the torch can be held with the left hand, and the retractable ring on the tail cap can be rotated by the right hand along a direction (for example along the clockwise direction) such that the life hammer extends out of the bottom face of the tail cap, and then people can use the life hammer to break window glass to rescue themselves and escape. When the life hammer is not in use, the retractable ring on the tail cap can be rotated in the reverse direction (for example the anticlockwise direction), and then the life hammer can retract into the tail cap.

The specific embodiments described in the text are used for illustrating the principle of the present invention only. Those skilled in the art can make various amendments or supplementations or take similar substitutions on the basis of the described specific embodiments. The amendments, supplementations, and substitutions should fall within the principle or the protective scope claimed by the claims of the present invention.

What is claimed is:

1. A torch tail cap, comprising:

a tail cap base, having a middle portion provided with an inner cavity;

a life hammer, axially inserted in the inner cavity of the tail cap base; and, a retractable ring, rotationally installed on the periphery of the tail cap base and connected with the life hammer, the retractable ring capable of driving the life hammer to extend out or retract back into the inner cavity during rotation.

2. The torch tail cap according to claim 1, further comprising a support rack for fixing the life hammer movably installed in the inner cavity; the retractable ring connected with the support rack; and by rotating the retractable ring, the support rack, together with the life hammer, being driven to move axially.

3. The torch tail cap according to claim 2, wherein the inner wall of the retractable ring is in a threaded connection with the outside wall of the support rack; the support rack is circumferentially limited in the inner cavity; and the retractable ring is axially limited on the periphery of the tail cap base.

4. The torch tail cap according to claim 3, further comprising a plurality of pins matched with the retractable ring integrally and circularly disposed on the periphery of the support rack; the outside walls of the plurality of pins all formed with external screw thread structures; and the inner wall of the retractable ring in a threaded connection with the outside walls of all pins at the same time.

5. The torch tail cap according to claim 4, wherein the tail cap base is provided with a plurality of guide sleeves which extend from the middle portion to the tail of the tail cap base and are matched with the support rack; the inner cavity is formed by enclosing the guide sleeves; the life hammer extends out of the tail of the tail cap base when extending out; the guide sleeves and the pins correspond to each other one by one and are disposed at intervals; two adjacent guide sleeves enclose to form a limiting gap which communicates with the inner cavity and circumferentially limits a corresponding one of the pins; and all pins are respectively circumferentially limited in corresponding limiting gaps.

6. The torch tail cap according to claim 5, wherein the outside wall of the tail of each one of the guide sleeves is provided with a thread head; a rear cap which axially limits the retractable ring is disposed at the tail of the tail cap base;

the tail cap base is disposed at the middle portion of the tail cap base; the inner wall of the rear cap is in a threaded connection with the thread heads of all guide sleeves at the same time; the middle portion of the rear cap is formed with a central through-hole through which the life hammer extends out and retracts.

7. The torch tail cap according to claim 6, further comprising a step structure disposed on the inner side of the tail of each one of the guide sleeves, and the step structures enclosing to form a support step; and a support retainer ring which is pressed against the inner wall of the rear capes disposed in a way of tightly fitting the support step.

8. The torch tail cap according to claim 7, wherein the end face of the tail of the support retainer ring is leveled with the end faces of the tails of the guide sleeves.

9. The torch tail cap according to claim 6, further comprising a reinforcing ring disposed in a way of tightly fitting the inner side of the central through-hole.

10. The torch tail cap according to claim 5, further comprising four pins; the four pins distributed on the periphery of the support rack in a "crossed" shape; and four corresponding limiting gaps distributed on the tail cap base in a way of a "crossed" open slot structure.

11. The torch tail cap according to claim 2, wherein the middle portion of the support rack is formed with a support through-hole, and the end portion of one end of the life hammer close to the middle portion of the tail cap base is inserted into the support through-hole and is tightly connected with the support rack.

12. The torch tail cap according to claim 1, further comprising a separating ring disposed at the middle portion of the tail cap base; the retractable ring rotationally installed in the middle portion of the tail cap base and connected with the separating ring; a first groove which is positioned on one side of the separating ring that faces the tail of the tail cap base disposed on the periphery of the middle portion of the tail cap base; and a damping rubber ring which contacts the retractable ring disposed in the first groove.

13. The torch tail cap according to claim 1, wherein external thread joints are disposed on the periphery of the head of the tail cap base.

14. The torch tail cap according to claim 1, further comprising a plurality of concave anti-sliding grooves are disposed around the periphery of the retractable ring.

15. The torch tail cap according to claim 1, wherein the middle portion of the head of the tail cap base is formed with a countersink; an electrode cap fixing seat is tightly installed in the countersink; an electrode cap is inserted into the head of the electrode cap fixing seat; the electrode cap is exposed out of the head of the tail cap base; a spring is disposed in the electrode cap fixing seat; and the two ends of the spring are respectively pressed against the inner wall of the electrode cap and the middle portion of the tail cap base.

16. A torch, comprising a torch body and a torch tail cap as described in claim 1 that is disposed at the tail of the torch body, wherein the head of the tail cap base and the torch body are in a detachable connection.

17. A torch, comprising a torch body and a torch tail cap as described in claim 12 that is disposed at the tail of the torch body, wherein the head of the tail cap base and the torch body are in a detachable connection.

18. The torch according to claim 17, further comprising a second groove that is positioned on one side of the separating ring that faces the head of the tail cover base disposed on the periphery of the middle portion of the tail cover base, and a sealing rubber ring which contacts the torch body disposed in the second groove.

* * * * *